United States Patent [19]

Dodds et al.

[11] Patent Number: 4,664,350

[45] Date of Patent: May 12, 1987

[54] SOFT-WALL HANGER

[76] Inventors: Kathleen M. Dodds; John H. Bishop, both of 1376 S. Mary Ave., Sunnyvale, Calif. 94087

[21] Appl. No.: 821,767

[22] Filed: Jan. 23, 1986

[51] Int. Cl.[4] ..... A47H 1/16

[52] U.S. Cl. ..... 248/303; 248/218.2; 248/493

[58] Field of Search ..... 248/302, 303, 215, 493, 248/218.1, 218.2, 216.1, 71, 497, 220.3, 221.2; 24/154, 351, 230.5 W, 129 C, 131 R, 458, 230.5 AD

[56] References Cited

U.S. PATENT DOCUMENTS

| | | | |
|---|---|---|---|
| 136,662 | 3/1873 | Mason | 248/218.2 |
| 2,524,403 | 10/1950 | Solomon | 24/230.5 W X |
| 2,642,038 | 6/1953 | Howling et al. | 248/218.1 X |
| 2,789,783 | 4/1957 | Jones | 248/218.2 |
| 3,289,992 | 12/1966 | Brooks | 248/220.3 |
| 3,633,251 | 1/1972 | Gass | 160/348 X |
| 3,871,608 | 3/1975 | Ogden | 248/220.4 X |

*Primary Examiner*—J. Franklin Foss

[57] ABSTRACT

A soft-wall hanger of unitary construction including a middle portion having a triple bend forming a pair of upwardly extending loops and a downwardly extending loop located therebetween. The triple bend inhibits accidental disengagement of the hanger from the soft-wall partition. A pair of elbows are formed at opposing ends of the soft-wall hanger to permit an item to be clamped to against the soft-wall partition, and a hook is formed on one of the end portions of the hanger so that items can be hung from the soft-wall partition.

4 Claims, 3 Drawing Figures

FIG-1-
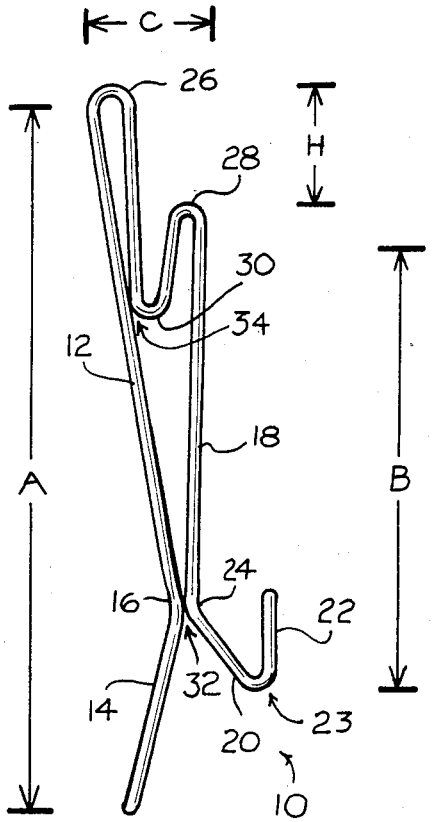
FIG-2-
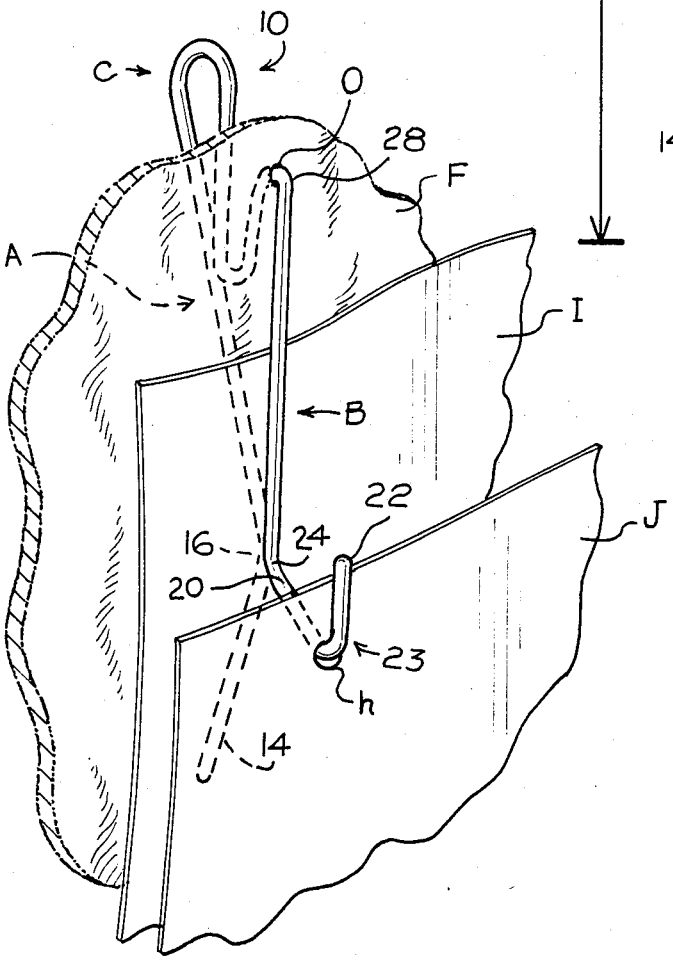
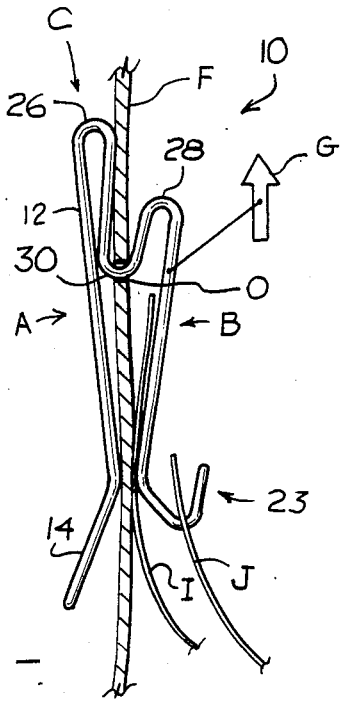
FIG-3-

SOFT-WALL HANGER

BACKGROUND OF THE INVENTION

1. Field of the Invention

This invention relates generally to hangers, and more particularly to wall hangers.

2. Description of the Prior Art

Many offices divide their floor space with soft-wall partitions to create various work areas. Soft-wall partitions are typically four to six feet in height, and are generally made by stretching fabric over a rigid frame. The partitions can have many different configurations, such as straight and curved, so that work areas can be designed to suit virtually any desired purpose. Soft-wall partitions may be provided with feet for free standing use; or may be semi-permanently attached to the floors and/or walls of the office by screws, bolts, and the like.

A problem with soft-wall partitions is that it is hard to hang things on them. For example, the occupant of a typical work area might wish to hang a calendar, picture, or note on the surface of a soft wall partition. Unfortunately, traditional methods for hanging objects do not work well with soft-wall partitions. The fabric of a soft-wall partition is too soft to accept a nail or tack, and is too delicate to support the weight of an object hanging from a simple hook.

Some office workers bend a paper clip into an S shaped hook and engage one end of the hook with the fabric of the partition. The other end of the hook can support a lightweight object provided with a hole. Problems with this rather primitive solution to the soft-wall hanger problem include the possibility of damage to the fabric of the partition, and the high likelihood of accidental disengagement of their hook from the soft-wall partition.

SUMMARY OF THE INVENTION

An object of this invention is to provide a soft-wall hanger which can be used to clamp an item to the surface of a soft-wall partition.

Another object of this invention is to provide a soft-wall hanger which can be used to hang an object from a soft-wall partition.

Yet another object of this invention is to provide a soft-wall hanger which is not easily accidently disengaged from a soft-wall partition.

Yet another object of this invention is to provide a soft-wall hanger which minimizes damage to the fabric to the soft-wall partition.

Briefly, the soft-wall hanger has a first end portion, a second end portion, and a middle portion having a triple bend which forms a pair of upwardly extending loops and a downwardly extending loop. The hanger is usually supported by a shorter of the upwardly extending loops, and the downwardly extending loop prevents accidental removal of the hanger from the soft-wall partition. The first and second end portions are bent to provide elbows which are biased towards each other to provide a clamping force which can hold item against the outer surface of the soft-wall partition. The second end portion is also provided with a hook from which items can be hung.

An advantage of this invention is that it is simple and inexpensive to manufacture.

Another advantage of this invention is that the triple bend of the middle portion of the hanger inhibits the accidental disengagement of the hanger from the soft-wall partition.

Another advantage of this invention is that it allows objects to be both clamped to and hung from a soft-wall partition.

A still further advantage of this invention is that it does not damage the fabric of the soft-wall partition.

These and other objects and advantages of the present invention will no doubt become apparent upon a reading of the following descriptions and a study of the several figures of the drawing.

BRIEF DESCRIPTION OF THE DRAWING

FIG. 1 is a front elevational view of a soft-wall hanger in accordance with the present invention, the rear elevational view being a mirror image thereof;

FIG. 2 is a perspective view of the soft-wall hanger of FIG. 1 engaged with the fabric of a soft-wall partition; and FIG. 3 is a cross sectional view through the fabric of the soft-wall partition which illustrates how the middle portion of the hanger prevents accidental disengagement from the soft-wall partition.

DETAILED DESCRIPTION OF THE PREFERRED EMBODIMENT(S)

Referring to FIG. 1, a soft-wall hanger in accordance with the present invention is preferably unitary in construction, and is made from a flexible, resilient material such as metal or plastic. If made from metal, it should be made from an oxidation resistant alloy or it should be coated to prevent oxidation, and should be springy enough so that it returns to its original shape after being flexed. If made from one of the many suitable thermoplastics, it should be made tough enough so that it does not break when flexed, and springy enough to return to its original shape.

As mentioned above, a soft-wall hanger 10 is preferably of single-piece construction. However, for the purposes of discussion, the soft-wall hanger 10 will be "divided" into three portions, namely a first end portion A, and second end portion B, and a middle portion C. The dividing points between the portions A, B, and C, have been picked somewhat arbitrarily and, once again, are included only for the purposes of discussion.

Soft-wall hanger 10 is preferably substantially uniform in cross-section although high stress areas, such as at bends, may be thicker. While the cross-sectional shape of the hanger 10 of this preferred embodiment is round, other cross-sectional configurations such as elliptical, rectangular, etc. are also suitable. Of course, the cross-sectional area and shape of the hanger can depend upon many factors, such as the material used to make the hanger, aesthetic considerations, etc.

First end portion A includes a substantially straight leg 12 and an acutely cantilevered foot 14. The bend at the juncture between leg 12 and foot 14 forms a first elbow 16. Second end portion B includes a substantially straight leg 18, an acutely angled foot 20, and an upwardly extending toe 22. The bend at the juncture between leg 18 and foot 20 forms a second elbow 24. Foot 20 and toe 22 cooperate to form a hook 23 from which items may be hung.

Middle portion C includes a first upwardly extending loop 26, a second upwardly extending loop 28, and a downwardly extending loop 30. As noted in FIG. 1, the first upwardly extending loop 26 extends upwardly higher than second upwardly extending loop 28 by a amount H.

The inherent flexibility and resiliency of the material from which soft-wall hanger 10 is made biases first elbow 16 and second elbow 24 together so that they can abut as shown at 32. Similarly, downwardly extending loop 30 is biased towards leg 12 by the resiliency of the material, such that it can abut leg 12 at 34.

Referring now to FIG. 2, soft-wall hanger 10 is engaged with the fabric F of a soft-wall partition. The first end portion A and the middle portion C are located inside the soft-wall partition, while the second end portion B is located on the outside of the soft-wall partition. The soft-wall hanger 10 extends through a small opening O in the fabric F of the soft-wall partition.

To attach the soft-wall hanger 10 to the fabric F, the foot 14 is pushed between fibers of fabric F to create the small opening O, and then the hanger 10 is pushed into the soft-wall partition and moved down until loop 26 engages opening O; then up until loop 30 engages opening O; and finally down until loop 28 rests in opening O. When the hanger is engaged in this manner, an item I (such as a sheet of paper) can be clamped between the outer surface of fabric F and elbow 24 by means of pressure exerted on the inner surface of fabric F by elbow 16. An item J (such as another piece of paper or a calendar) provided with a hole h can be hung from hook 23.

It should be noted that hanger 10 is supported at two places, namely both by the second upwardly extending loop 28 and by the clamping action between elbows 16 and 24. The clamping action reduces the pressure exerted on opening O, preventing damage to the fibers of fabric F. In fact, it has been found that after the removal of a soft-wall hanger 10, the opening O becomes almost unnoticeable if the fabric F around the opening O is rubbed gently to move the fibers back into place.

Referring now to FIG. 3, the features of the present invention which make it difficult to accidentally disengage the soft-wall hanger 10 from the fabric F will be discussed. When an upward force G is exerted on a soft-wall hanger 10, as indicated by the large arrow, the entire hanger moves in an upward direction until the downwardly extending loop 30 engages the opening O. At this point, the hanger 10 will be prevented from moving upwardly any further, unless the force G is great enough to enlarge the opening O or to tear the fabric F. After the upward force G is removed, the hanger 10 can stay in the position shown in FIG. 3, or it may be pulled back to the proper position shown in FIG. 2 either by the weight of an item J or by hand, if necessary.

The hanger 10 is further prevented from accidental removal from the fabric F due to the abutment between downwardly extending loop 30 and leg 12. Sufficient force must be exerted on loop 30 to move it away from leg 12 to permit the fabric F to slide along the hanger.

Yet another feature of hanger 10 which makes inhibits its accidental disengagement is that the first upwardly extending loop 26 is of greater height than the second upwardly extending loop 28. To disengage the soft-wall hanger 10 from fabric F the hanger would first have to be moved upwardly for the height of second upwardly extending loop 28 until it engages the downwardly extending loop 30, and then would have to be moved downwardly for the height of the first upwardly extending loop 26, and finally moved upwardly for the distance of leg 12 and foot 14.

As is evident from the foregoing discussion, the triple bend of the middle portion C of the soft-wall hanger 10 makes accidental disengagement of the soft-wall hanger 10 from the soft-wall partition extremely unlikely. However, it is nonetheless a straightforward matter to remove the hanger 10 from the soft-wall partition when desired. To remove the soft-wall hanger 10, the hanger is moved upwardly until the downwardly extending loop 30 is engaged with the opening O, then is pulled slightly outwardly to move the downwardly extending loop 30 away from leg 12, then is pulled downwardly until the first upwardly extending loop 26 is engaged with the opening O, and then is pulled upwardly until leg 12 and foot 14 are pulled from the opening O.

While this invention has been described in terms of a few preferred embodiments, it is contemplated that persons reading the preceding descriptions and studying the drawing will realize various alterations, permutations and modifications thereof. It is therefore intended that the following appended claims be interpreted as including all such alterations, permutations and modifications as fall within the true spirit and scope of the present invention.

What is claimed is:

1. A soft-wall hanger made from a flexible, resilient material and comprising:

a first end portion, a second end portion, and a middle portion between said first end portion and said second end portion;

wherein said first end portion includes a first elbow, and an acutely cantilevered section provided at an end distal from said middle portion, and wherein said second end portion includes a second elbow, and a hooked section provided at an end distal from said middle portion, whereby said first elbow and said second elbow are biased toward each other by a first biasing force inherent in the resiliency of said material from which said hanger is made, said first elbow and said second elbow being adapted to abut each other in the absence of any intervening obstacle and in the absence of any force exerted against said first end portion and said second portion which is greater than said biasing force; and wherein said middle portion has a triple bend forming a first upwardly extending loop which is proximate to said first end portion, a second upwardly extending loop which is proximate to said second end portion, and a downwardly extending loop located therebetween, said first upwardly extending loop having a greater height than said second upwardly extending loop, wherein said downwardly extending loop is biased towards said first end portion by a second biasing force inherent in the resiliency of said material from which said hanger is made.

2. A soft-wall hanger as recited in claim 1 wherein said downwardly extending loop is adapted to abut said first end portion in the absence of any intervening obstacle and in the absence of any force exerted on said downwardly extending loop and said first end portion which is greater than said second biasing force.

3. A soft-wall hanger made rom a flexible, resilient material and comprising:

a first end portion, a second end portion, and a middle portion between said first end portion and said second end portion;

said middle portion having a triple bend forming a pair of upwardly extending loops and a downwardly extending loop located therebetween, wherein said downwardly extending loop is biased towards said first end portion by the resiliency of said material from which said hanger is made.

4. A soft-wall hanger as recited in claim 3 wherein said downwardly extending loop is adapted to abut said first end portion in the absence of any intervening obstacle and in the absence of any force exerted on said downwardly extending loop and said first end portion which is greater than the biasing force exerted by the resiliency of said material.

* * * * *